US007311101B2

(12) United States Patent
Nakashima

(10) Patent No.: US 7,311,101 B2
(45) Date of Patent: Dec. 25, 2007

(54) END SUPPORTING PLATE FOR SINGLE CRYSTALLINE INGOT

(75) Inventor: Akira Nakashima, Imari (JP)

(73) Assignee: Sumco Corporation, Tokyo (JP)

( * ) Notice: Subject to any disclaimer, the term of this patent is extended or adjusted under 35 U.S.C. 154(b) by 146 days.

(21) Appl. No.: 11/226,368

(22) Filed: Sep. 15, 2005

(65) Prior Publication Data

US 2006/0060180 A1 Mar. 23, 2006

(30) Foreign Application Priority Data

Sep. 17, 2004 (JP) ..... 2004-272339

(51) Int. Cl.
*B28D 1/08* (2006.01)

(52) U.S. Cl. ..... 125/21; 125/35; 156/268; 156/510

(58) Field of Classification Search ..... 125/12, 125/21, 13.01, 35; 156/268, 64, 378, 257, 156/510

See application file for complete search history.

(56) References Cited

U.S. PATENT DOCUMENTS 4,292,352 A * 9/1981 Singer ..... 428/14
6,760,403 B2 * 7/2004 Aydelott et al. ..... 378/79
6,802,928 B2 10/2004 Nakashima
2004/0050483 A1 * 3/2004 Ghyselen et al. ..... 156/230

FOREIGN PATENT DOCUMENTS

JP 2004-001409 1/2004

* cited by examiner

*Primary Examiner*—Jacob K. Ackun, Jr.
(74) *Attorney, Agent, or Firm*—Pillsbury Winthrop Shaw Pittman, LLP

(57) ABSTRACT

This invention relates to an end supporting plate which can be attached to both ends of cylindrical ingot. By wire saw cutting, semiconductor wafers are sliced from the ingot attached with the end supporting plates. The end supporting plate has an elongated support surface. Maximum width of the support surface along a direction perpendicular to an axial direction of the plate is smaller than the length along the axial direction. The length of the support surface is approximately similar to a diameter of the ingot to which the end support plate is to be attached, whereas maximum width of the support is smaller than the diameter of the ingot.

10 Claims, 4 Drawing Sheets

END SUPPORTING PLATE FOR SINGLE CRYSTALLINE INGOT

BACKGROUND OF THE INVENTION

1. Field of the Invention

The invention relates to an end supporting plate for a single crystalline ingot, particularly relates to improvement of an end supporting plate attached to a cylindrical single crystalline ingot during wire saw cutting of semiconductor wafers from the ingot.

Priority is claimed on Japanese Patent Application No. 2004-272339, filed Sep. 17, 2004, the content of which is incorporated herein by reference.

2. Description of Related Art

A wire saw is an apparatus for cutting an ingot. In wire saw cutting, cutting of a work piece (ingot) is performed by pressing the work piece to an array of running wires soaked with abrasive slurry (abrasive fluid of slurry state) suspending abrasive grains in lapping oil. Since a wire saw uses a very fine wire, it can slice thin semiconductor wafers from the ingot.

However, in conventional wire saw cutting, compared to semiconductor wafers sliced from central barrel portion of an ingot, wafers sliced from end portions of the ingot could not have escaped from remarkable occurrence of nanotopography (waviness in finite area) and/or warpage.

A capable cause of nanotopography and warpage is a thermal on or contraction of groove rollers by temperature variation during cutting process. Temperature by heating of a bearing for rotating and supporting the groove roller, and processing heat of the wire and abrasive slurry during grinding. By this temperature elevation, locus of wires drift towards both ends of the groove roller.

Based on the extensive investigation on the occurrence of nanotopography and warpage of semiconductor wafers sliced from single crystalline silicon ingots, the inventor found the method described in Japanese Unexamined Patent Application, First Publication No. 2004-1409. In that method, dummy plates are attached to both ends of a cylindrical single crystalline ingot. The dummy plates are glass plates having cylindrical shapes of approximately same diameter with the ingot. Alternatively applicable form of glass plate has a predetermined thickness and approximately similar size with the ingot diameter in the cutting direction, and in its vertical direction.

The single crystalline ingot attached with the dummy plates are sliced to semiconductor wafers by a wire saw. By attaching the dummy plates to the ingot, the end portions of the ingot being sensitive to adverse effect of nanotopography and warpage is replaced by dummy plates. Therefore, the occurrence of nanotopography and warpage can be effectively reduced in the silicon wafers.

A wire saw is also used for slicing of semiconductor wafers with a diameter of 300 mm. In order to reduce a calf loss (cutting loss) of the semiconductor wafer, it has been investigated the reduction of wire thickness and use of fine size of abrasive grains.

However, the glass end supporting plates are harder than a single crystalline silicon ingot. When an ingot attached with the above described end supporting plates is sliced by a wire saw, along with decreasing grain size of free abrasive grain, grinding effect of the abrasive grain for a work piece pressed to the wire is also reduced. The reduction of grinding effect causes a difference in cutting speed of the end supporting plate and the ingot, increases load on the wire, and results in breaking of the wire.

The present invention was carried out based on the above consideration and its objective is to provide an end supporting plate which can reduce nanotopography and warpage of semiconductor wafers after slicing, and also to provide an end supporting plate which can protect the wire from breaking due to the use of fine (high number of) grain size of abrasive grains in the wire saw cutting.

SUMMARY OF THE INVENTION

End supporting plates of the invention are attached to both axial ends of an ingot to prevent a production of deformed waters during wire saw cutting of the ingot. The end supporting plate has a support surface by which the plate is attached to the axial end of the ingot. The support surface has a length along an axial direction of the end supporting plate, and a maximum width along a direction perpendicular to the axial direction. The maximum width of the support surface is smaller than the length of the support surface, and therefore the support surface has an elongated shape. When the supporting plate is attached to a single crystalline ingot, the length of the support surface along the axial direction of the supporting plate is approximately similar to a diameter of the ingot for which the plate is attached. At that time maximum width of the support surface in a direction perpendicular to the long axis of the plate is smaller than the diameter of the ingot. The end supporting plate is attached to the ingot so that a long axis of the plate elongates along cutting direction of the ingot.

The support surface of the end supporting plate may have an approximately rectangular shape (shape analogous to rectangle) having long edge of similar size with a diameter of an ingot to which the plate is attached and short edge shorter than the diameter of the ingot. The end supporting plate is attached to the ingot so that long edges elongate along cutting direction of the ingot, and short edges elongate perpendicular to the ingot.

Preferably, the support surface of the end supporting plate may have an approximately trapezoidal shape. The end support plate having a trapezoidal surface is attached to an ingot so that width of the support surface at a starting position of cutting is shorter than a width of the support surface at an ending position of cutting.

The end supporting plate may have various elongated shape. For example, when the ingot is pressed to the wire by downward movement, the end supporting plate may have V-like shape outline or oval outline in front view of cut surface of the ingot.

The length of the support surface along the axial direction of the end supporting plate is approximately similar to the diameter of the ingot. That is, the length may have the same size, slightly short size, or slightly long size compared to the diameter of the ingot. Preferably, the long length of the support surface is greater than 95% of the diameter of the ingot and smaller than 105% of the diameter of the ingot.

The maximum width of the support surface in the direction perpendicular to the long axis of the end supping plate is not limited to any specific size provided that it is shorter than the diameter of the ingot. To obtain the effect of the invention, it is preferable that the ratio of the maximum width and length of the support surface is 0.1 and more, and 1 and less. More preferably, the ratio of the maximum width and length of the support surface is 0.2 and more, and 0.6 and less.

End support plates of the invention have no limitation in their thickness. To obtain the effect of the invention, it is preferable that an average thickness of the end supporting plate is not less than 5 mm, and not greater than 50 mm.

The ingot attached with the end supporting plate is not limited to any specific material species. For example, the end supporting plates may be attached to Si or GaAs ingot. There is no limitation for a diameter of the ingot being attached with the end supporting plates. For example, the ingot may have a diameter of 200 mm, or of 300 mm. The long length of the end supporting plate is determined in accordance with a diameter of the ingot to which the plate is attached.

The end supporting plates may be made of glass, ceramics, carbon or resin. Technically, silicon single crystal may also be used for an end supporting plate, but its use is not appropriate from the view of cost performance.

The invention is not limited by a construction of a wire saw for cutting the single crystalline ingot. The wire saw may be constructed so that the ingot is cut by being pressed to the wire by downward movement, or by upward movement. There is no limitation for the wire diameter, nor for grain size of free abrasive grains used in the wire saw cutting.

In the invention, end supporting plates, for example, glass end supporting plates are attached to both ends of the cylindrical single crystalline ingot. Each end supporting plate is formed to have elongated surface and attached to the ingot so that the long axis of the plate elongates along a wire cutting direction of the ingot. The support surface of end supporting plate may have an approximately rectangular shape and attached to the ingot so that the long edge of the plate elongates to the wire cutting direction and short edges of the plate elongate perpendicular to the cutting direction. The long edges have approximately similar size with the diameter of the ingot, and short edges have sizes shorter than the diameter of the ingot.

In this constitution of the end supporting plate, a contact area of the plate with a wire is smaller than that of a cylindrical end supporting plate used in the prior art, therefore load on the wire from the plate is effectively reduced. Even when higher number of (fine) abrasive grains are used in the grinding by a wire saw, difference in cutting speed of the ingot from plate is sufficiently reduced, and breaking of the wire may be effectively prevented.

Usually, degree of warpage increases from starting cutting portion to ending cutting portion in sliced wafers. Especially, ending cutting portion tends to occur undesirable nanotopography and wake. This problem is caused by large change in wire tension due to simultaneous cutting of the ingot and slice table attached to the ending cutting portion of the ingot for its support. Therefore, the plate is made to have a trapezoidal support surface and attached to the ingot so that a width of the plate edge pressed to the wire in the starting of cutting is shorter than a width of the opposite edge where the cutting is ended. By this constitution, nanotopography and warpage in the ending cutting portion can be effectively suppressed.

In the invention, both axial ends of a cylindrical single crystalline ingot are respectively attached with the end supporting plates. Each end supporting plate is made to have an elongated surface. When the surface has an approximately rectangular shape, the end supporting plate is attached to an axial end of an ingot so that long edges of the plate elongate along the wire cutting direction and short edges of the plate elongate perpendicular to the wire cutting direction. The long edges have approximately similar length as the diameter of the ingot, and the short edges have a shorter length than the diameter of the ingot. By this shape, compared to the conventional glass end supporting plate, surface area of the plate contacting with the wire during the cutting process can be effectively reduced and load on the wire is reduced. Even when the high number of abrasive grains (fine abrasive grains) are used, load on the wire is effectively reduced so that the breaking of the wire can be prevented.

Moreover, nanotopography or warpage of a semiconductor wafer is larger in the ending cutting portion than in starting cutting portion. Since the effect of nanotopography and warpage is more prominent in the ending cutting portion than in the starting cutting portion of the wafer, by using end supporting plates having trapezoidal support surface having shorter width at the starting cutting position than the width at the ending cutting position, nanotopography and warpage is effectively reduced in the ending cutting portion of the wafer.

DETAILED DESCRIPTION OF THE INVENTION

An embodiment of the invention is explained with reference to the drawings through FIGS. 1A to 4B.

Firstly, a wire saw 10 used in the embodiment is explained with reference to FIG. 2.

Figure 2:
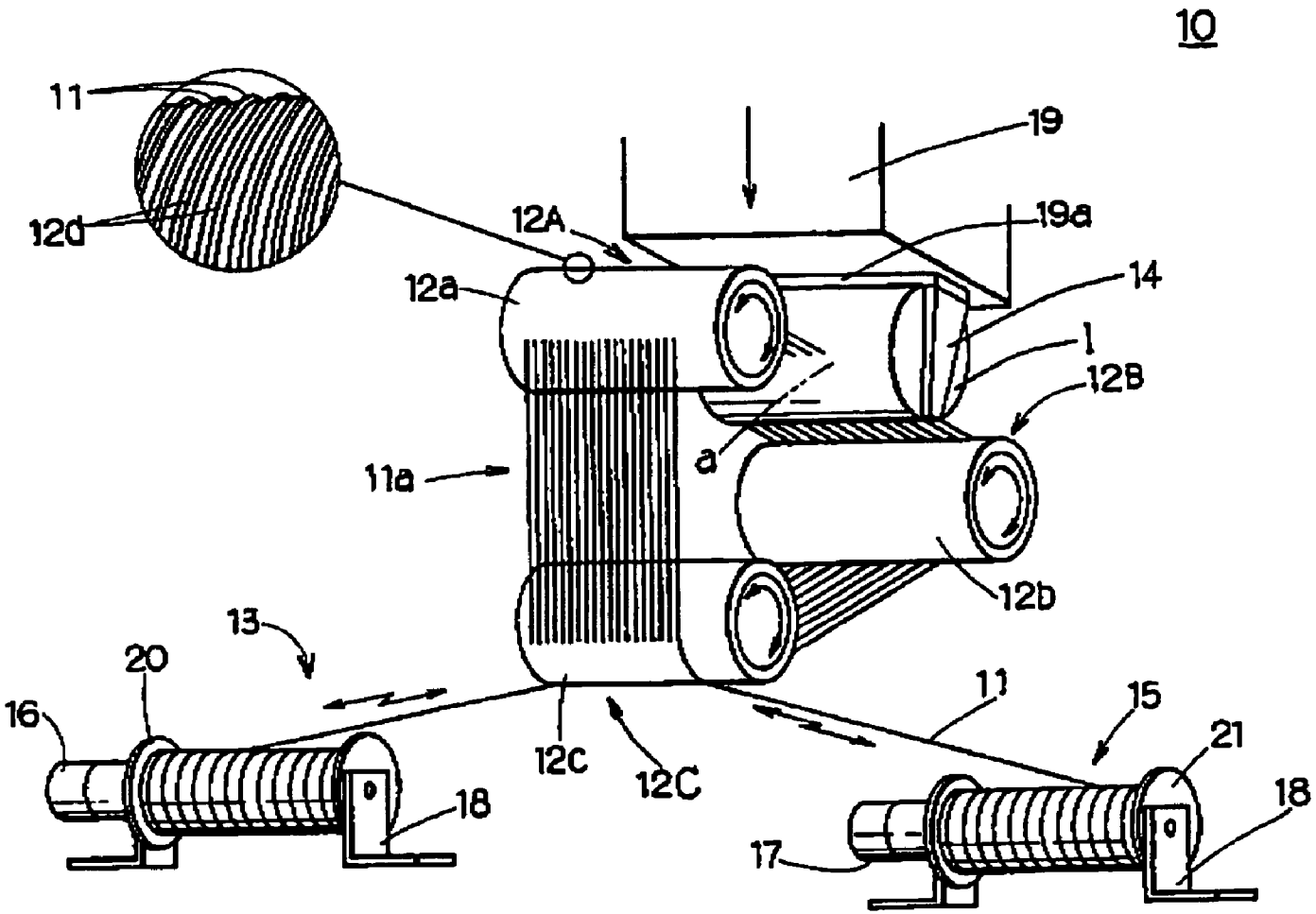
FIG. 2 is a schematic diagram of a wire saw of an embodiment of the invention.

FIG. 2 is a perspective view showing a construction of a wire saw 10 according to an embodiment of the invention. As shown in FIG. 2, the wire saw 10 comprises three groove rollers 12A, 12B and 12C in a triangular arrangement in the front view. Between the groove rollers, a wire 11 is wound with a predetermined pitch in a parallel arrangement. In such a manner, a wire array 11*a* is provided between the groove rollers 12A, 12B, and 12C. Drive motors run the wire array 11*a* reciprocally between the three groove rollers 12A, 12B and 12C. A cutting position a of the wire array 11*a* for slicing a single crystalline ingot I is set in an intermediate position between the two groove rollers 12A and 12B.

A single crystalline ingot I is, intervening a slice table 19*a,* fixed to the lower surface of a work plate 19 for lifting and lowering the single crystal. Above both sides of the single crystalline ingot cutting position a, slurry feeding units (not shown) are, for example in a pair arrangement, provided to feed abrasive slurry suspending abrasive grains in lapping oil.

The groove rollers 12A, 12B, 12C have cylindrical shapes and their circumferences surfaces are coated with lining members 12*a,* 12*b,* and 12*c* composed of urethane rubber.

Outer circumference surface of the lining members 12*a*, 12*b* and 12*c* are grooved to have wire grooves 12*d*.

A music wire is used as the wire 11. The wire 11 runs from a bobbin 20 of a supply unit 13, and is hung over the groove rollers 12A, 12B and 12C via a guiding roller (not shown) set in the supplying part. After that the wire is wound by a bobbin 21 of a winding unit 15 via a guiding roller (not shown) in the leading part. Rotational axes of the bobbins 20 and 21 are respectively joined to output axes of drive motors 16 and 17.

When the drive motors 16 and 17 drive synchronously, the wire 11 is reciprocated by clockwise or counterclockwise rotation of bobbins 20 and 21 around their rotation axes supported by a pair of bearings.

In a wire saw of the embodiment, cutting of a single crystalline ingot is performed by pressing the ingot to the wire by downward movement. Alternatively, the invention may be applied to a wire saw for cutting an ingot by pressing the ingot to the wire by upward movement.

Cutting procedure of a single crystalline ingot I in an embodiment is explained in the following.

Firstly, boron-doped silicon single crystal grown by the CZ method is prepared. Next this grown single crystal is cut into a cylindrical block form using circular saw or band saw. Circumference surface of the cylinder is grinded to have a diameter close to the object size (for example 300 mm). After at, an orientation flat (OF) or notch are formed along a crystallographic orientation measured by X-ray diffractometry.

Figure 1A:
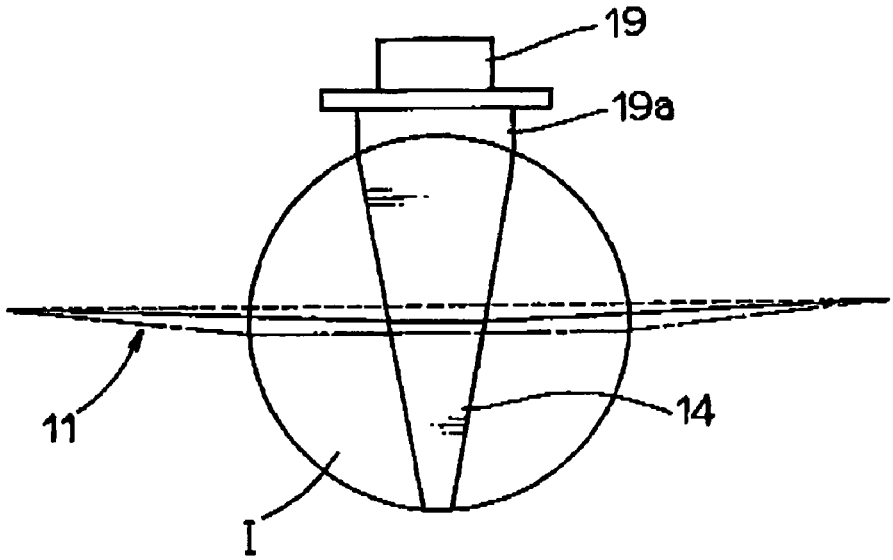
FIG. 1A is a front view showing a form of end supporting plate of an embodiment of the invention.

The cylindrical single crystalline ingot I is fixed to lower side of slice table 19*a*. In this embodiment, two glass end supporting plates 14 are respectively attached to the both end of the single crystalline ingot I. The attached glass end supporting plates 14 have a support surface of approximately rectangular shape having long edges elongating to the cutting direction by the wire saw and short edges perpendicular to the cutting direction. Long edges of the end supporting plate 14 along the axial direction have similar length (for example 300 mm) to the diameter of the single crystalline ingot. Short edges of the end supporting plate 14 have a width smaller than the diameter of the single crystalline ingot. It is preferable that an average thickness of the end supporting plate is not less than 5 mm, and not greater than 50 mm. Alternatively, as shown in FIG. 1A, the end supporting plate 14 may have a trapezoidal shape. The end supporting plate 14 has a length approximately similar to the diameter of the ingot I (for example 300 mm) and is attached to the axial end of the single crystalline ingot I so that the longitudinal axis of the plate elongates along the cutting direction of the ingot. A width of short edge of the trapezoidal plate at an ending position of cutting is longer than a width of opposite edge of the plate at a starting position of cutting. Preferably the length along the axial direction of the end supporting plate is greater than 95% and smaller than 105% of a diameter of the ingot to which the plate is attached. Preferably, a ratio of the maximum with and the length of the plate is 0.1 and more, and 1 and less. In this embodiment, the short edge at a starting position of cutting is approximately 20 mm in width, and the short edge at an ending position of cutting is approximately 150 mm in width. The thickness of the end supporting plate 14 in this embodiment is about 20 mm. However, the present invention is not limited to these embodiments. For example, the plate 14 may be chamfered to remove the corner portion, or may have curved edges.

The end supporting plate may be adhered to the axial end surface of the ingot I. Alternatively, by providing a mechanical system such as link system to the both side of single crystalline ingot I, the end supporting plates 14 may be pressed to the single crystal by cylinders or the like. By this mechanism, for example, warpage of a semiconductor wafer may be reduced during the cutting process.

As shown in FIG. 2, a work plate 19 is lowered toward cutting position a. The wire saw 10, along with feeding abrasive slurry to the wire array 11*a*, rotates the bobbin 20 of the supply unit 13 by the drive motor 16. Simultaneously, the bobbin 21 of winding unit is rotated by the driving motor 17 and winds the wire 11 intervening groove rollers 12A, 12B, 12C and the guiding roller at the leading part. At that time, by changing the rotational direction of bobbins 20 and 21, the wire 11 runs reciprocally with high speed. Through this movement, two groove rollers 12A and 12B, and both guide rollers are rotated. At that time, a grove roller 12C is rotated by a rotation motor (not shown) to support the reciprocal movement of the wire array 11*a*.

By that wire saw 10, silicon ingot I is sliced to silicon wafers of 300 mm in diameters and about 1 mm in thickness. Simultaneously, glass end supporting plates attached to the both end surface of single crystalline ingot are sliced during the same cutting process.

Temperature variation of a groove roller under the cutting process causes a thermal extension and contraction of the groove roller. Temperature elevation also occurs by hating of bearings (not shown) rotating and supporting the groove roller, and process heating of wire 11 and abrasive slurry during grinding process. By this elevation temperature, locus of the wire 11 drifts towards both ends of groove rollers. Such drift of wire locus get remarkable nanotopography or warpage in the cutting direction of silicon wafers sliced from both end portions of the single crystalline ingot.

In the embodiment, glass end supporting plates are attached to the ends of the single crystal. By this embodiment, silicon wafers sliced from a single crystalline ingot are relatively free from adverse effect of nanotopography or warpage.

Conventionally, both ends of the single crystalline ingot were attached with glass end supporting plates 114 having a predetermined thickness and a similar size with the diameter of single crystalline ingot in cutting direction and in its perpendicular direction.

Figure 3A:
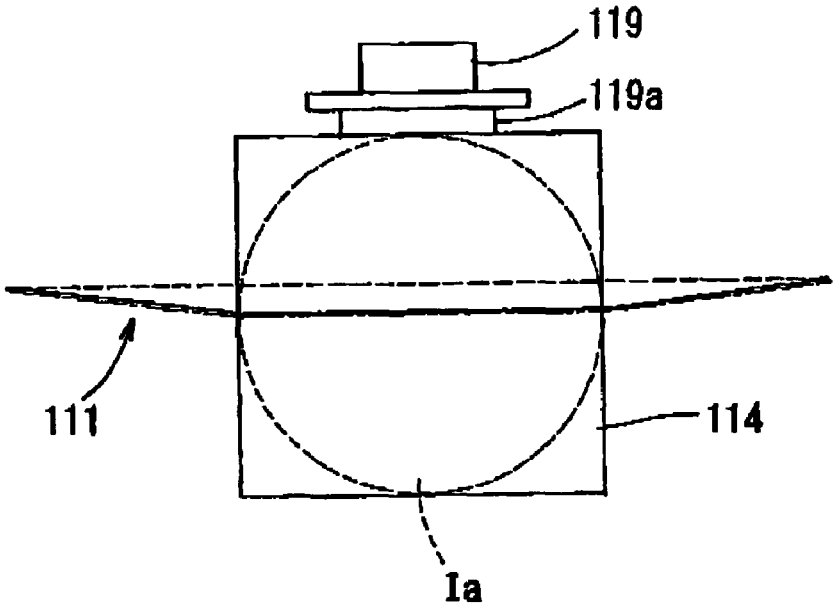
FIG. 3A is a front view of a conventional end supporting plate used in the grinding with abrasive grains of size number #1000.
Figure 3B:
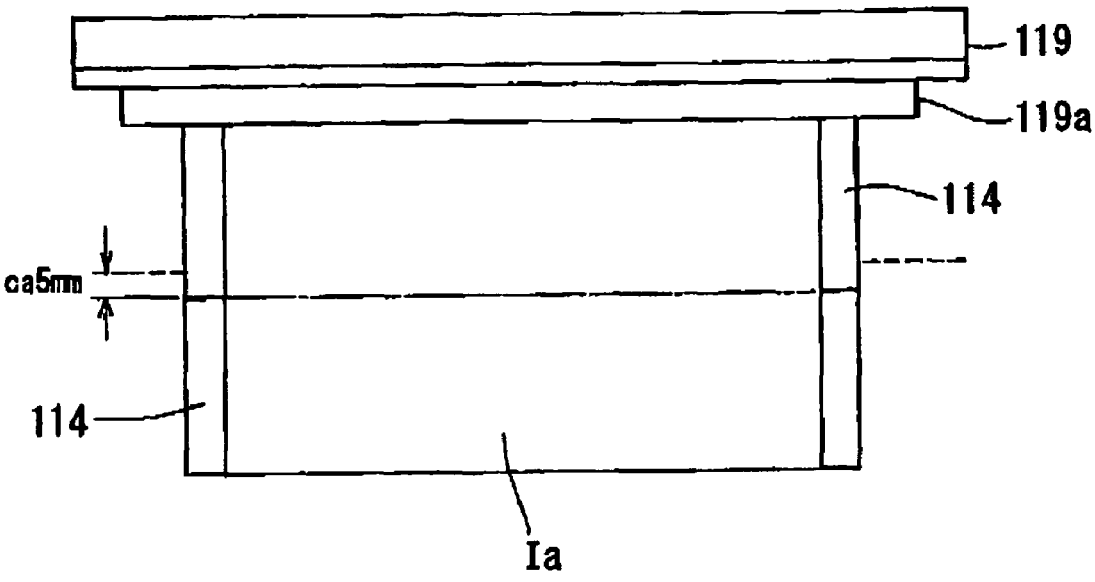
FIG. 3B is a side view of the end supporting plate of FIG. 3A.

As shown in FIGS. 3A and 3B, when the cutting is performed using abrasive grains of size number #1000, compared to the normal wire position during slicing (dashed line in FIG. 3B), bending of the wire 111 at the position of the end supporting plate (solid line in FIG. 3B) is approximately similar to a bending of the wire 111 at the position of the single crystalline ingot (chain line in FIG. 3B) and the value of bending is approximately 5 mm.

Figure 4A:
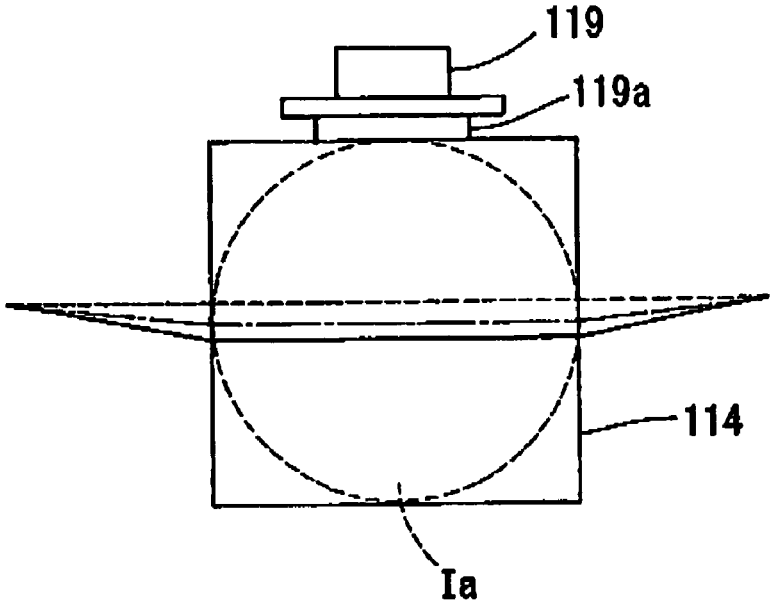
FIG. 4A is a front view of a conventional end supporting plate used in the grinding with abrasive grains of size number #1500.
Figure 4B:
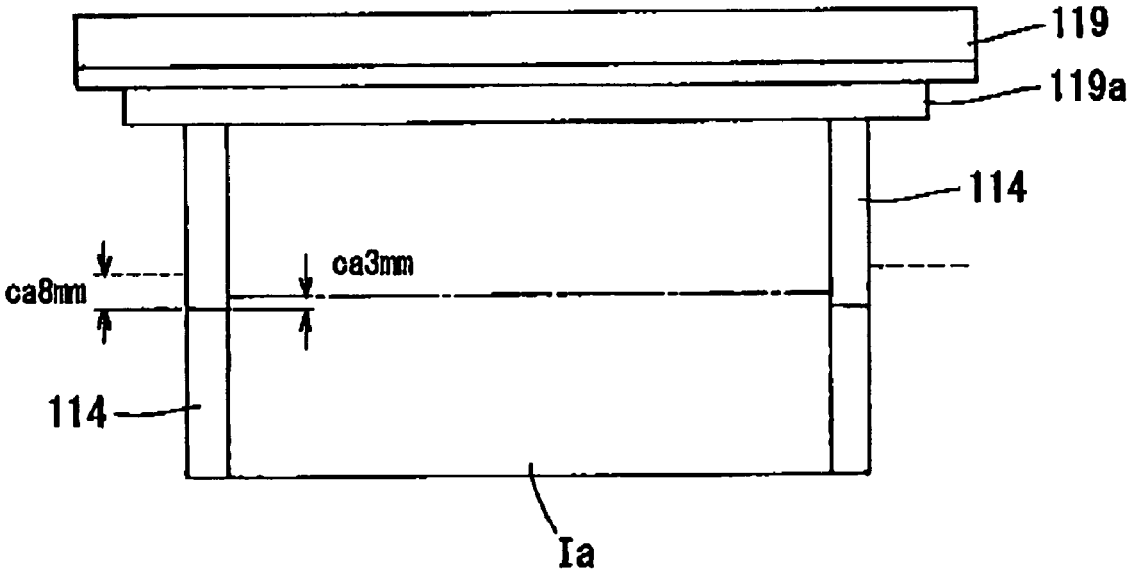
FIG. 4B is a side view of the end supporting plate of FIG. 4A.

When the cutting is performed using abrasive grins of size number #1500, bending of the wire 111 at the position of the single crystalline ingot I (chain line in FIG. 4B) is about 5 mm compared to the normal wire position during slicing (dashed line in FIG. 4B). Whereas, the bending of the wire at the position of the end supporting plate (solid line in FIG. 4B) is about 8 mm. Thus, the relatively large being of the wire 111 at the position of glass end supporting plate have caused a breaking of the wire 111.

In an embodiment of the present invention, the end supporting plate 14 has an approximately trapezoidal shape and is attached to the ingot so that short edges of the plate are perpendicular to the cutting direction. The length of the plate is approximately similar to the diameter of the ingot, while the maximum width of the plate 14 is smaller than the diameter of the single crystalline ingot.

Figure 1B:
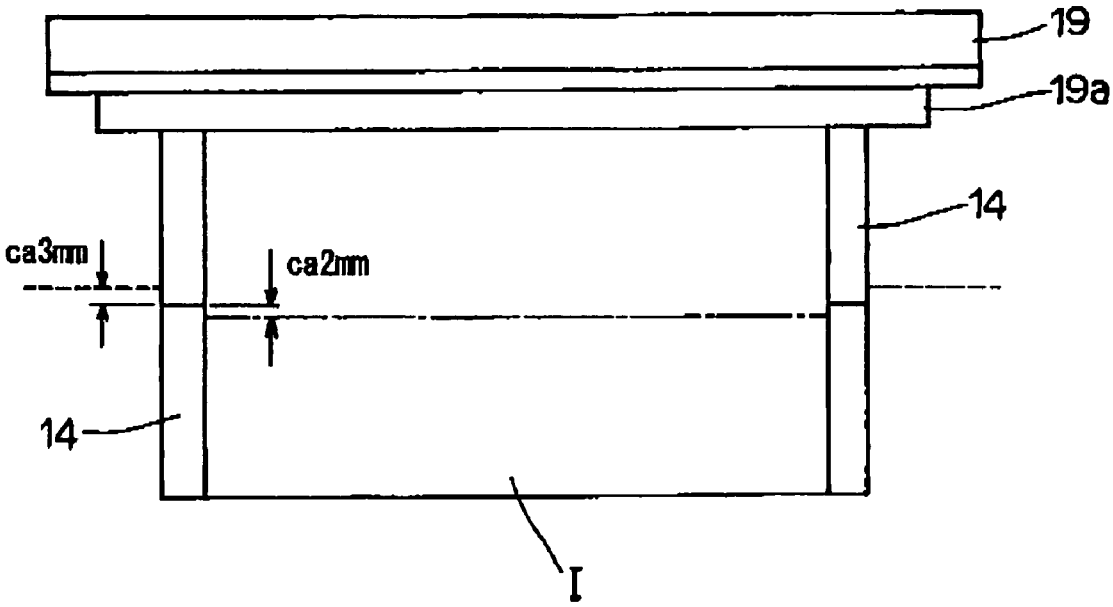
FIG 1B is a side view of the end supporting plate of FIG. 1A.

As a result, as shown in FIGS. 1A and 1B, when the cutting is performed using abrasive gains of size number #1500, bending of the wire 11 at the position of the single crystalline ingot I (chain line in FIG. 1B) is about 5 mm compared to the normal wire position during slicing (dashed line in FIG. 4B). Whereas, the bending of the wire at the position of end s plate (solid line in FIG. 1B) is reduced to 3 mm. This reduction of bending can be explained by smaller surface area of the end supporting plate contacting with the wire 11 than that of the conventional end supporting plate having orthogonal or cylindrical shape. By the reduction of contact surface with the wire 11, reduction of load on the wire result in suppression of breaking of the wire 11.

In addition, the end supporting plates 14 have a trapezoidal shape and are attached to the ingot so that a width of the plate at a starting position of cutting is shorter than the width of the plate at an ending position of cutting. By this construction, in the ending cutting portion of a semiconductor wafer being sensitive to the adverse effect of wire drifting, nanotopography or warpage are effectively reduced.

After slicing, silicon wafers are chamfered, and subsequently lapped in the lapping process. After the lapping, silicon wafers are etched with alkali etching liquid. Surface of the etched wafers are polished by batch processing mirror polisher. The mirror finished silicon wafers are finished with RCA cleaning to complete the processing of silicon wafers.

Comparative Observation

Comparative observation of wafer state was performed on silicon wafers, by wire saw cutting, sliced from an ingot attached with end supporting plates of the invention, and end supporting plates of the conventional art.

Cylindrical glass end supporting plates (diameter: 300 mm; thickness: 20 mm) having a same diameter with the ingot, and glass end supporting plates according to the invention (short edge: 170 mm; opposite short edge: 30 mm; long edge: 300 mm; thickness: 20 mm) were prepared. The plates are respectively attached to both ends of ingots (diameter: 300 mm) which are subsequently sliced to silicon wafers by wire saw cutting. After mirror finishing the sliced silicon wafers, nanotopographies of silicon wafers were measured using a measuring apparatus called nano-mapper. Warpages of the silicon wafers were also examined using a capacitance type flatness gage of ADE Technologies Inc. Additionally, ratio of wire bag were also examined.

Abrasive slurry suspending abrasive grains of size number #1500 in lapping oil, and a wire of 0.14 mm in diameter was used for cutting. The results are listed in Table 1. There, Ave and Std respectively represent average and standard deviation of normal distribution of a plurality of results obtained by observation of 232 wafers. Wire breaking ratios are calculated from the result of cutting 30 ingots.

TABLE 1

| | | | | COMPARATIVE EXAMPLE | EXAMPLE V-like shape |
|---|---|---|---|---|---|
| NANO TOPOGRAPHY | 2 mm SQUARE | Ave | nm | 8.54 | 8.07 |
| | | Std | nm | 2.15 | 1.36 |
| | 10 mm SQUARE | Ave | nm | 23.13 | 22.72 |
| | | Std | nm | 4.56 | 4.76 |
| ADE | WARPAGE | Ave | μm | 13.94 | 13.51 |
| | | Std | μm | 4.22 | 4.61 |
| WIRE BREAKING RATIO | | | % | 7.39 | 3.33 |

The results listed in Table 1 indicate that degrees of nanotopography and warpage of wafers sliced using end supporting plates of the invention are corresponding to those of wafers sliced using conventional end supporting plates.

On the other hand, when ingots are attached with end supporting plates of the invention during the wire saw cutting, wire breaking ratio is 3.33% which is apparently lower than the wire breaking ratio of 7.39% in the case where the ingot was attached with conventional end supporting plates during the wire saw cutting. The results indicate that effective reduction of wire breaking ratio can be obtained by utilizing end supporting plates of the invention.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A method of producing a semiconductor wafer, the method comprising:

attaching a support plate to each of axial end surfaces of a single crystalline ingot; and slicing a wafer from the single crystalline ingot by wire saw cutting, wherein the supporting plate includes a support surface to be attached to the axial end surfaces of the single crystalline ingot, the support surface having a length along an axial direction of the supporting plate and a maximum width along a direction perpendicular to the axial direction, and the maximum width of the support surface being smaller than the length of the support surface, where the length along the axial direction of the supporting plate is greater than 95% and smaller than 105% of a diameter of the single crystalline ingot.

2. A method of producing a semiconductor wafer according to claim 1, wherein the support surface of the supporting plate has an approximately rectangular shape.

3. A method of producing a semiconductor wafer according to claim 1, wherein the support surface of the supporting plate has an approximately trapezoidal shape and can be attached to the single crystalline ingot so that a width of the support surface at a starting portion of cutting is shorter than a width of the support surface at an ending portion of cutting.

4. A method of producing a semiconductor wafer according to claim 1, wherein the support surface of the supporting plate has long edges and short edges shorter than the long edges.

5. A method of producing a semiconductor wafer according to claim 1, wherein the length along the axial direction of the end supporting plate is approximately similar to a diameter of the single crystalline ingot, and the maximum width of the support surface is smaller than the diameter of the single crystalline ingot.

6. A method of producing a semiconductor wafer according to claim 1, wherein the end supporting plate is made of a material selected from a group of glass, ceramic, and resin.

7. A method of producing a semiconductor wafer according to claim 1, wherein a ratio of the maximum width and the length of the plate is 0.1 and more, and 1 and less.

8. A method of producing a semiconductor wafer according to claim 1, wherein a ratio of the maximum width and length of the support surface of the supporting plate is about 0.2 to about 0.6.

9. A single crystalline ingot for producing a semiconductor wafer, comprising:

a cylindrical body of single crystalline semiconductor ingot having end surfaces in the axial direction thereof, and supporting plates adhered to the end surfaces, wherein each of the supporting plates include a support surface adhered to the end surface of the single crystalline ingot, the support surface having a length along an axial direction of the supporting plate and a maximum width along a direction perpendicular to the axial direction, and the maximum width of the support surface being smaller than the length of the support surface, where the length along the axial direction of the supporting plate is greater than 95% and smaller than 105% of a diameter of the single crystalline ingot.

10. A single crystalline ingot for producing a semiconductor wafer according to claim 9, wherein a ratio of the maximum width and length of the support surface of each of the supporting plates is about 0.2 to about 0.6.

* * * * *